US009328568B2

(12) United States Patent
Andrigo

(10) Patent No.: US 9,328,568 B2
(45) Date of Patent: May 3, 2016

(54) CASING CENTRALIZER AND METHOD OF MANUFACTURING SAME

(71) Applicant: Top-Co Cementing Products Inc., Weatherford, TX (US)

(72) Inventor: Gregory James Alexander Andrigo, Almonte (CA)

(73) Assignee: Top-Co Cementing Products, Inc., Weatherford, TX (US)

( * ) Notice: Subject to any disclaimer, the term of this patent is extended or adjusted under 35 U.S.C. 154(b) by 210 days.

(21) Appl. No.: 14/044,485

(22) Filed: Oct. 2, 2013

(65) Prior Publication Data

US 2014/0151026 A1 Jun. 5, 2014

Related U.S. Application Data

(60) Provisional application No. 61/731,777, filed on Nov. 30, 2012.

(51) Int. Cl.
*E21B 17/10* (2006.01)

(52) U.S. Cl.
CPC ..... *E21B 17/1078* (2013.01); *E21B 17/1042* (2013.01)

(58) Field of Classification Search
CPC ... E21B 17/10; E21B 17/1042; E21B 17/105; E21B 17/1078; E21B 17/1085
See application file for complete search history.

(56) References Cited

U.S. PATENT DOCUMENTS 2,251,428 A * 8/1941 Smith ..... E21B 17/105 138/157
2,715,552 A * 8/1955 Lane ..... E21B 17/1042 175/325.5
3,320,004 A * 5/1967 Garrett ..... E21B 17/1042 175/325.5
3,410,613 A * 11/1968 Kuus ..... E21B 17/105 175/325.7
5,833,019 A * 11/1998 Gynz-Rekowski ... E21B 17/105 166/241.6

* cited by examiner

*Primary Examiner* — Giovanna C Wright
(74) *Attorney, Agent, or Firm* — Kirk Dorius; Reed & Scardino LLP

(57) ABSTRACT

A casing centralizer and method according to which a body covers at least a portion of a frame. In an exemplary embodiment, the body is overmolded around the frame. In an exemplary embodiment, the casing centralizer centralizes a casing within a wellbore to facilitate oil and gas exploration and production operations.

16 Claims, 11 Drawing Sheets

CASING CENTRALIZER AND METHOD OF MANUFACTURING SAME

CROSS-REFERENCE TO RELATED APPLICATION

This application claims priority to, and the benefit of the filing date of, U.S. Patent Application No. 61/731,777, filed Nov. 30, 2012, the entire disclosure of which is incorporated herein by reference.

BACKGROUND

This disclosure relates in general to oil and gas exploration and production operations and, in particular, to casing centralizers for centralizing a casing within a wellbore, to facilitate oil and gas exploration and production operations.

DETAILED DESCRIPTION

Figure 1:
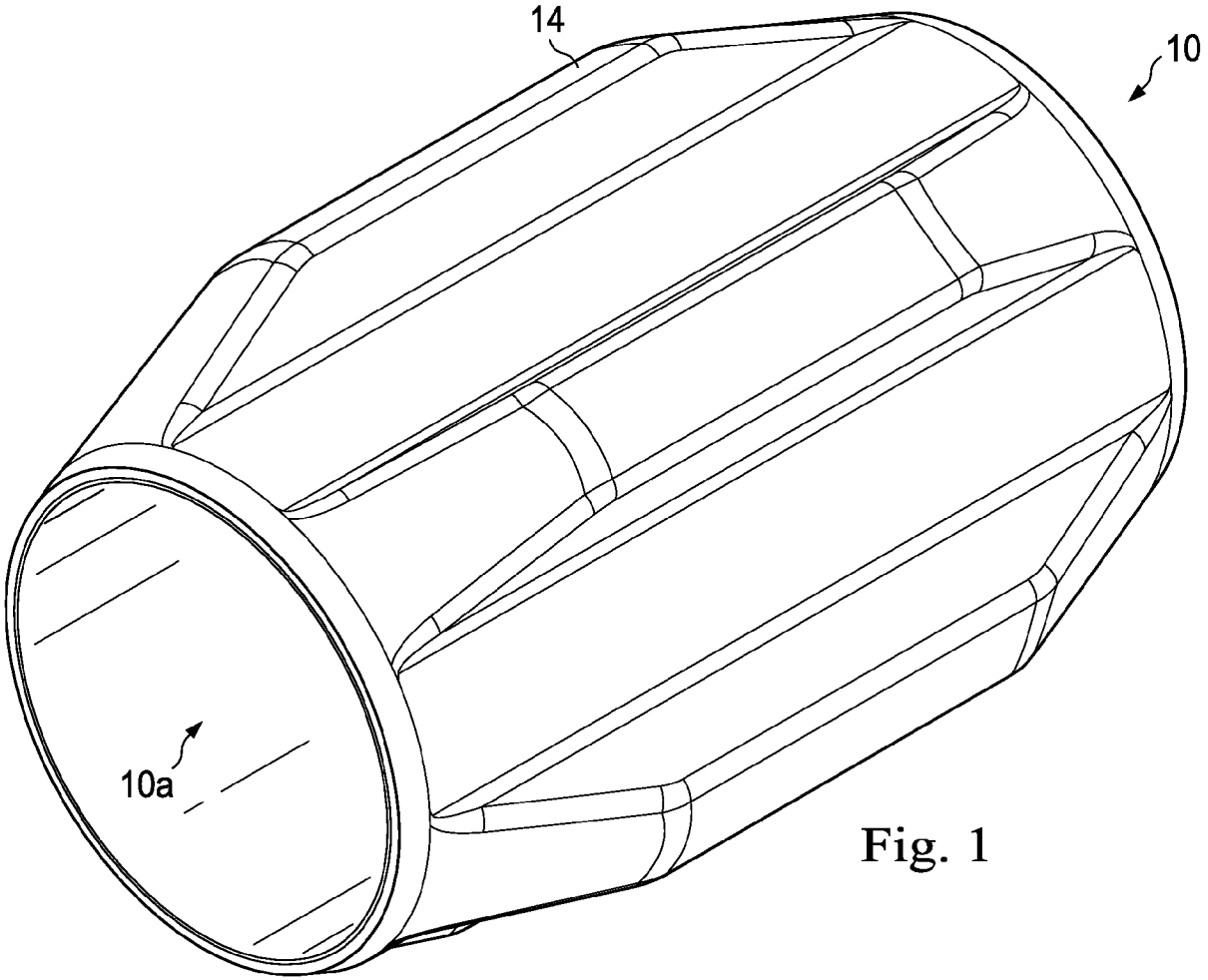
FIG. 1 is a perspective view of a casing centralizer according to an exemplary embodiment.
Figure 2:
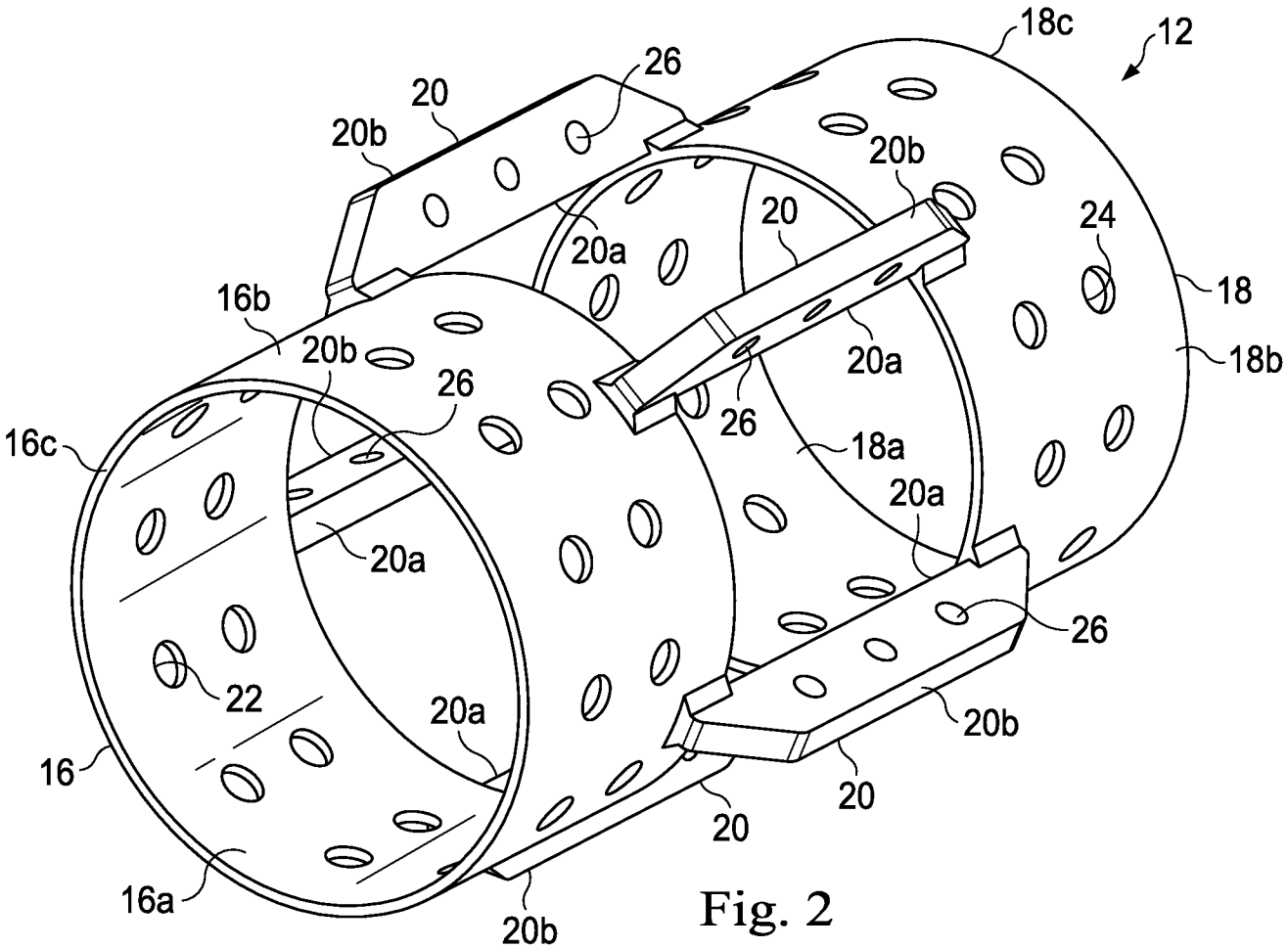
FIG. 2 is a perspective view of a frame of the casing centralizer of FIG. 1, according to an exemplary embodiment.
Figure 3:
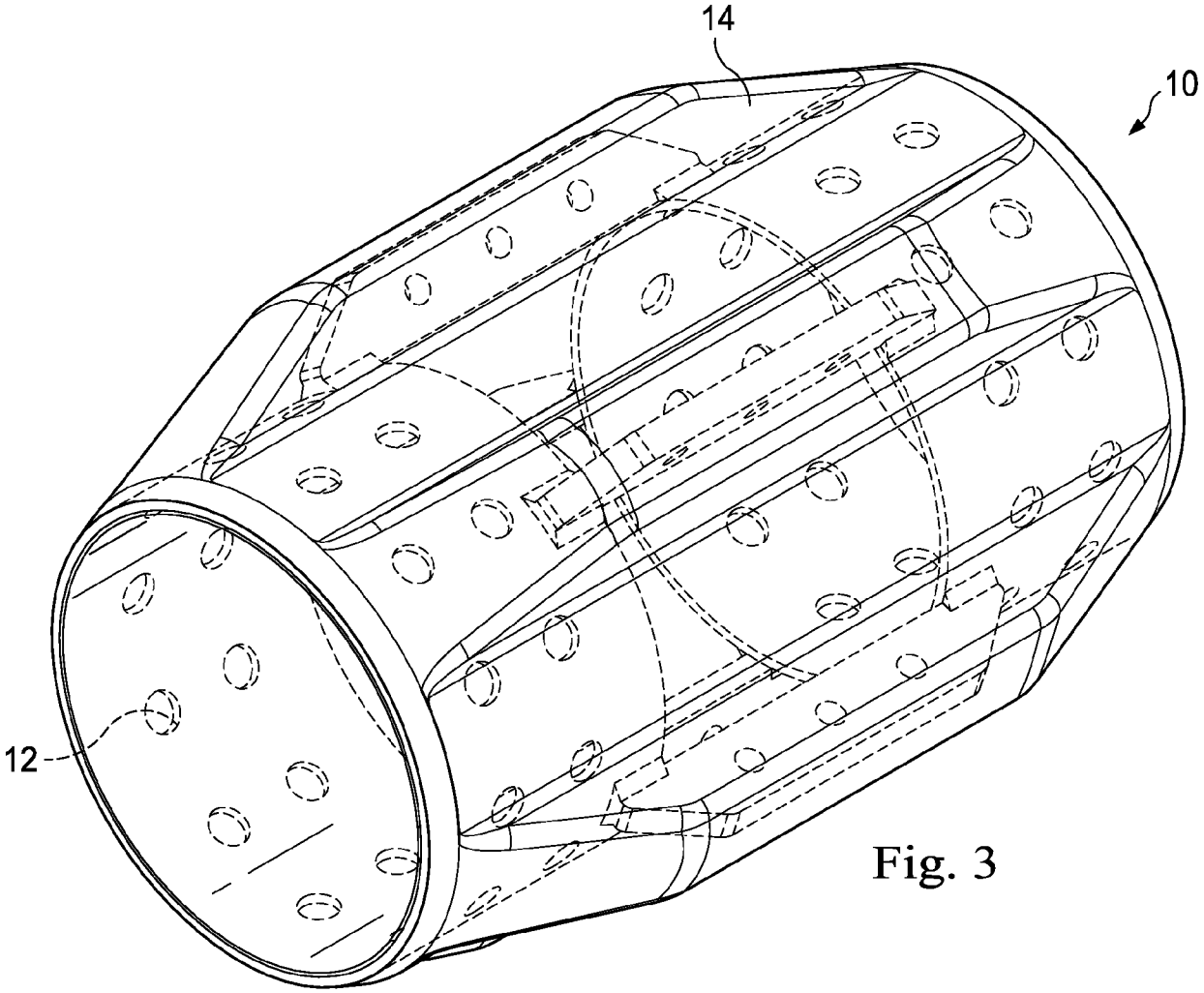
FIG. 3 is a perspective view of the casing centralizer of FIG. 1, and includes a hidden line depiction of the frame of FIG. 2, according to an exemplary embodiment.

In an exemplary embodiment, as illustrated in FIGS. 1-3, a casing centralizer is generally referred to by the reference numeral 10 and includes a frame 12 and a body 14 covering substantially the entire frame 12. In an exemplary embodiment, to manufacture the casing centralizer 10, the frame 12 is provided, and the body 14 is overmolded around the frame 12 so that the body 14 covers substantially the entire frame 12. The casing centralizer 10 defines an internal passage 10*a*.

As shown in FIG. 2, in an exemplary embodiment, the frame 12 includes a tubular member such as, for example, a band or collar 16, and another tubular member such as, for example, a band or collar 18, which is spaced axially from the collar 16. The collar 16 defines an inside surface 16*a* and an outside surface 16*b*. The collar 18 defines an inside surface 18*a* and an outside surface 18*b*. A plurality of circumferentially-spaced bars such as, for example, fins or ribs 20, extend between the collars 16 and 18. Each of the ribs 20 includes a base portion 20*a* and a distal end portion 20*b* that is radially offset from the base portion 20*a*. The base portion 20*a* is connected to each of the collars 16 and 18. In several exemplary embodiments, instead of, or in addition to the ribs 20, one or more other types of circumferentially-spaced bars extend between the collars 16 and 18, such as, for example, tubular bars, flat bars, spokes, other types of structural members or supports, or any combination thereof. In several exemplary embodiments, a plurality of openings 22 are formed through the collar 16, a plurality of openings 24 are formed through the collar 18, and a plurality of openings 26 are formed through each of the ribs 20. In an exemplary embodiment, each of the openings 26 is circular-shaped, square-shaped, or has another shape. In several exemplary embodiments, instead of, or in addition to the openings 22, 24 and 26, notches may be formed in the collar 16, the collar 18, and each of the ribs 20, respectively.

In an exemplary embodiment, as illustrated in FIGS. 4-7 with continuing reference to FIGS. 1-3, the body 14 includes a tubular portion 14*a* defining an inside surface 14*b* and an outside surface 14*c*, along which a plurality of vane portions 14*d* extend. The tubular portion 14*a* covers the collars 16 and 18 so that the collars 16 and 18 are disposed radially between the inside surface 14*b* and the outside surface 14*c*. Each of the vane portions 14*d* covers one of the respective distal end portions 20*b* of the ribs 20. In an exemplary embodiment, the ribs 20 are embedded in respective ones of the vane portions 14*d*. As shown in, for example, the sectional view of FIG. 7, the vane portions 14*d* cover the respective distal end portions 20*b* so that the respective distal end portions 20*b* are disposed radially between the vane portions 14*d* and the collars 16 or 18.

In an exemplary embodiment, the frame 12 is composed of a first material, and the body 10 is composed of a second material that is different from the first material. In an exemplary embodiment, the first material may include a metallic material such as steel or aluminum, and the second material may include a non-metallic material such as plastic. In several exemplary embodiments, each of the first and second materials may include one or more metallic materials such as steel or aluminum, one or more non-metallic materials such as plastic, or any combination thereof. In an exemplary embodiment, the frame 12 is a metal frame, and the body 14 is composed of one or more non-metallic materials such as plastics; as a result, the casing centralizer 10 has high strength with low friction.

Figure 5:
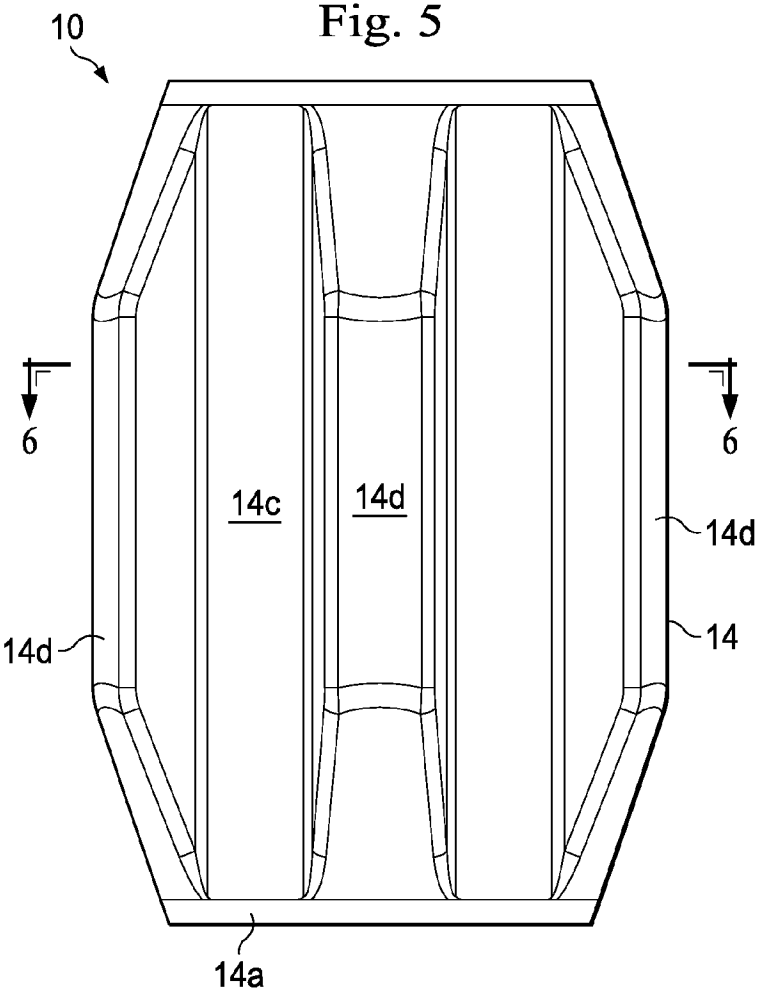
FIG. 5 is a side elevational view of the casing centralizer of FIG. 1, according to an exemplary embodiment.
Figure 4:
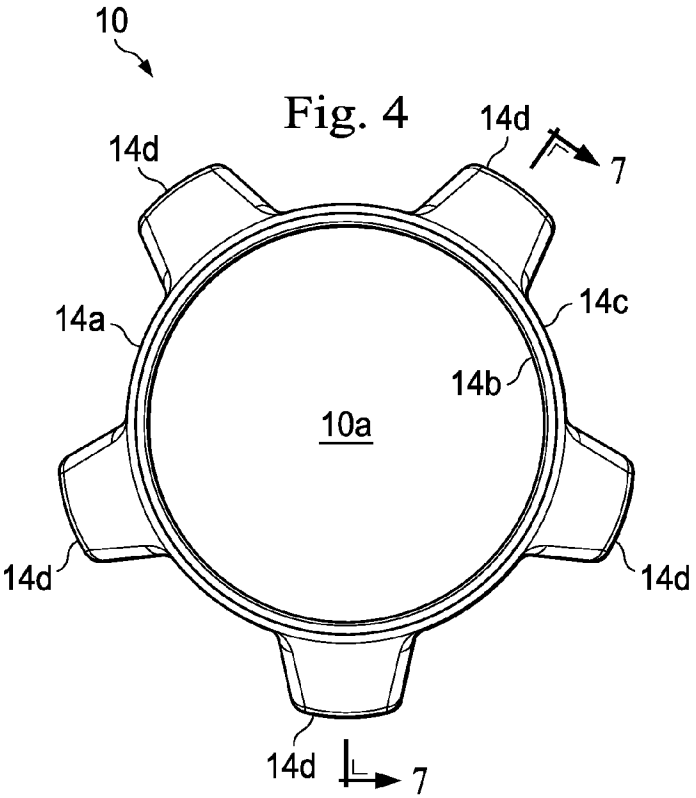
FIG. 4 is a top plan view of the casing centralizer of FIG. 1, according to an exemplary embodiment.
Figure 7:
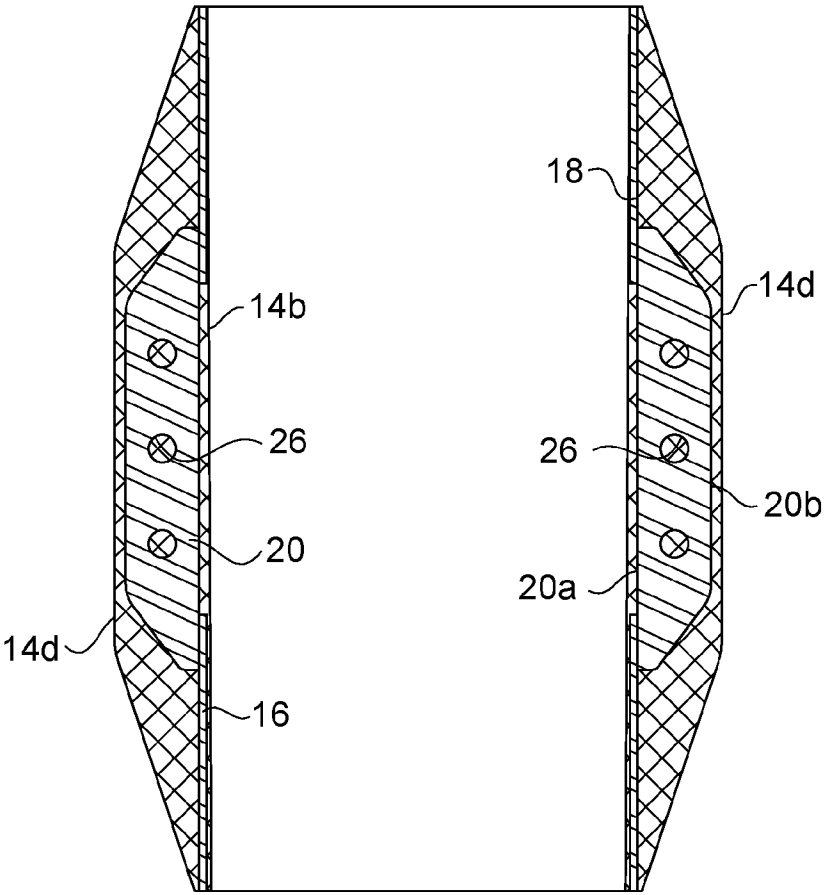
FIG. 7 is a sectional view of the casing centralizer of FIG. 4 along line 7-7 thereof, according to an exemplary embodiment.
Figure 6:
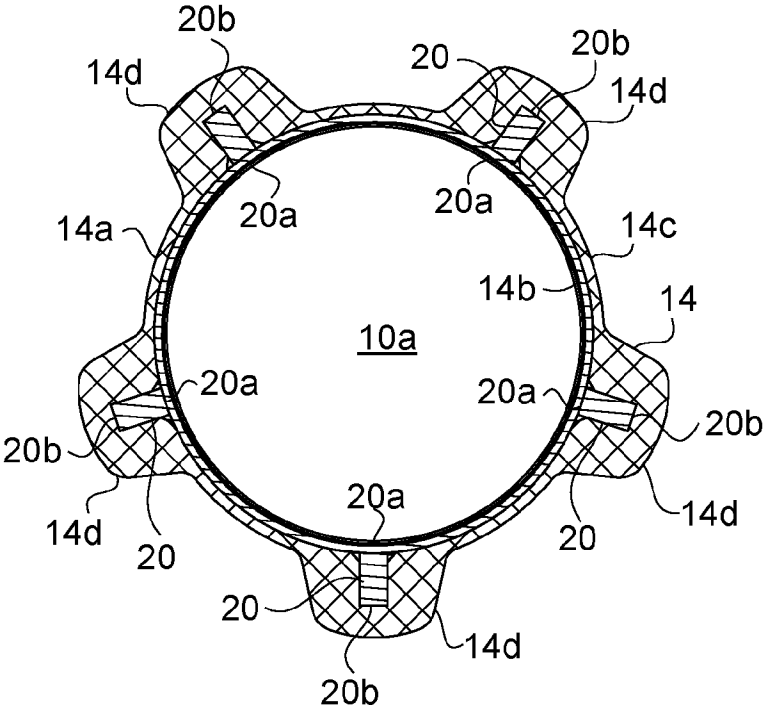
FIG. 6 is a sectional view of the casing centralizer of FIG. 5 taken along line 6-6 thereof, according to an exemplary embodiment.

As shown in FIGS. 1, 3, and 5, each of the vane portions 14*d* are straight, extending along a straight line between the axial end portions 16*c* and 18*c* of collars 16 and 18, respectively. As shown in FIGS. 2, 3, and 7, each of the ribs 20 extends along a straight line between the collars 16 and 18. Alternatively, in an exemplary embodiment, each of the ribs 20 extends spirally between the collars 16 and 18, even though the vane portions 14*d* extend along a straight line.

Figure 8:
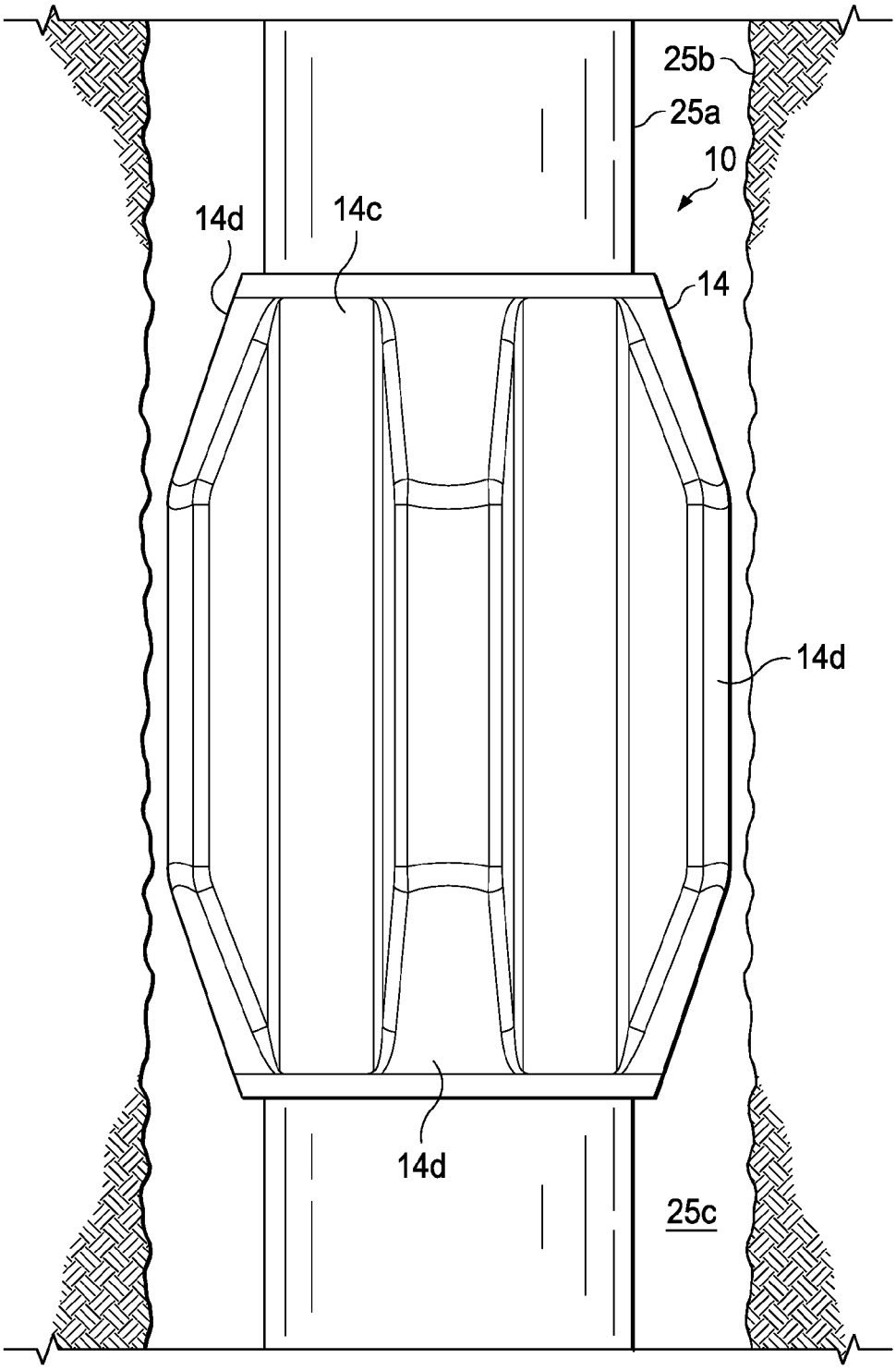
FIG. 8 is an elevational view of the casing centralizer of FIGS. 1-7 extending within a wellbore, according to an exemplary embodiment.
Figure 9:
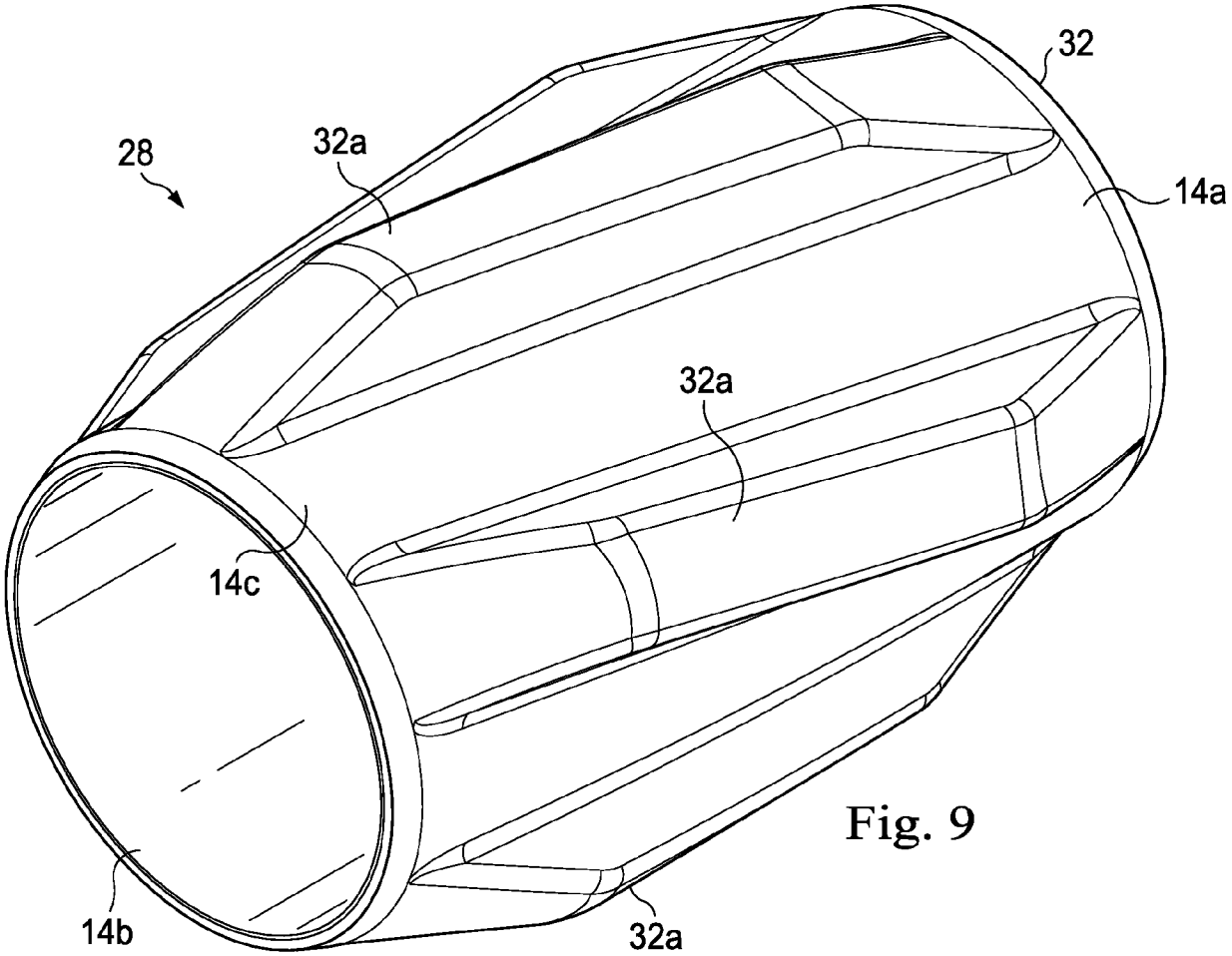
FIG. 9 is a perspective view of a casing centralizer according to another exemplary embodiment.
Figure 10:
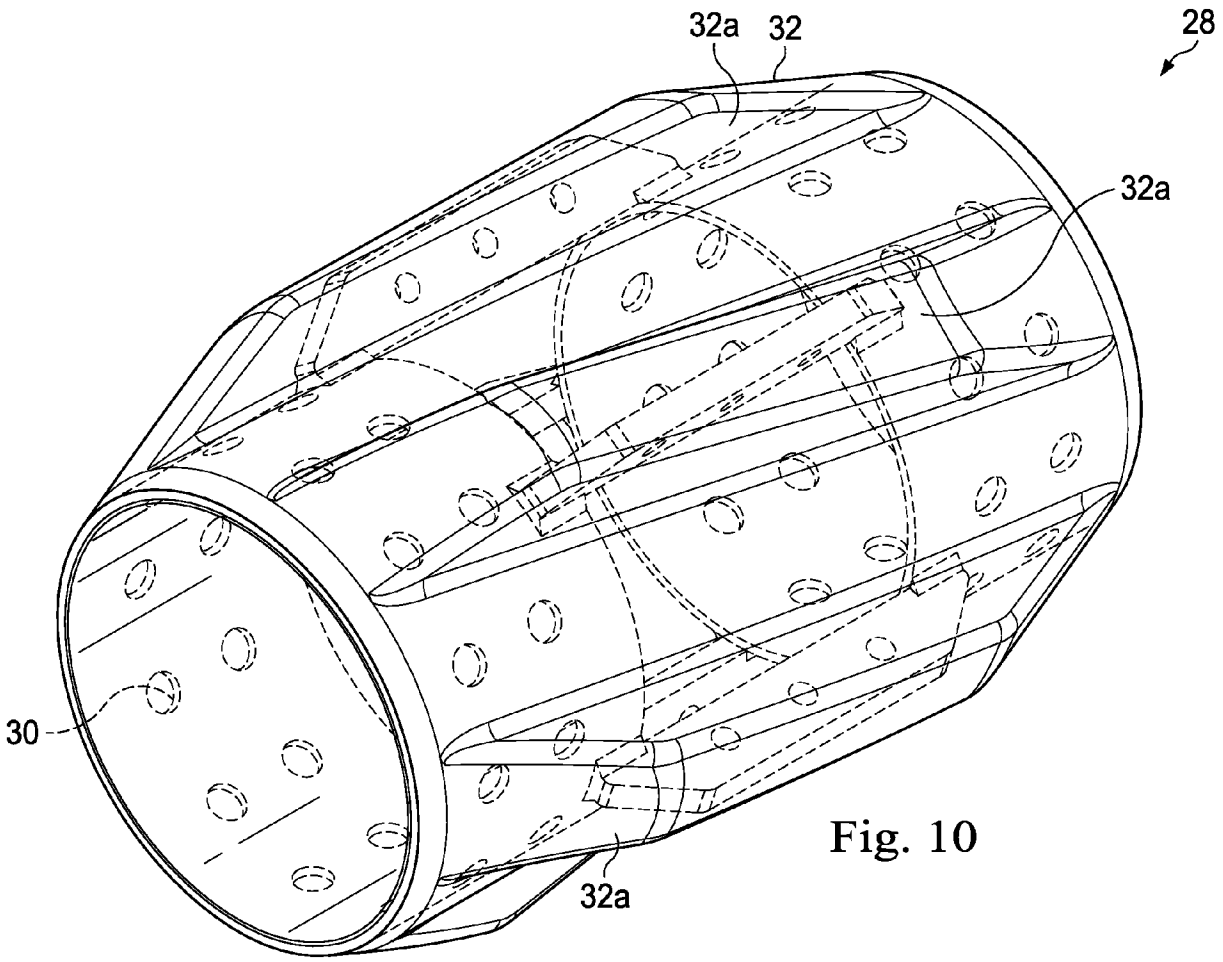
FIG. 10 is a perspective view of the casing centralizer of FIG. 9, and includes a hidden line depiction of a frame thereof, according to an exemplary embodiment.
Figure 12:
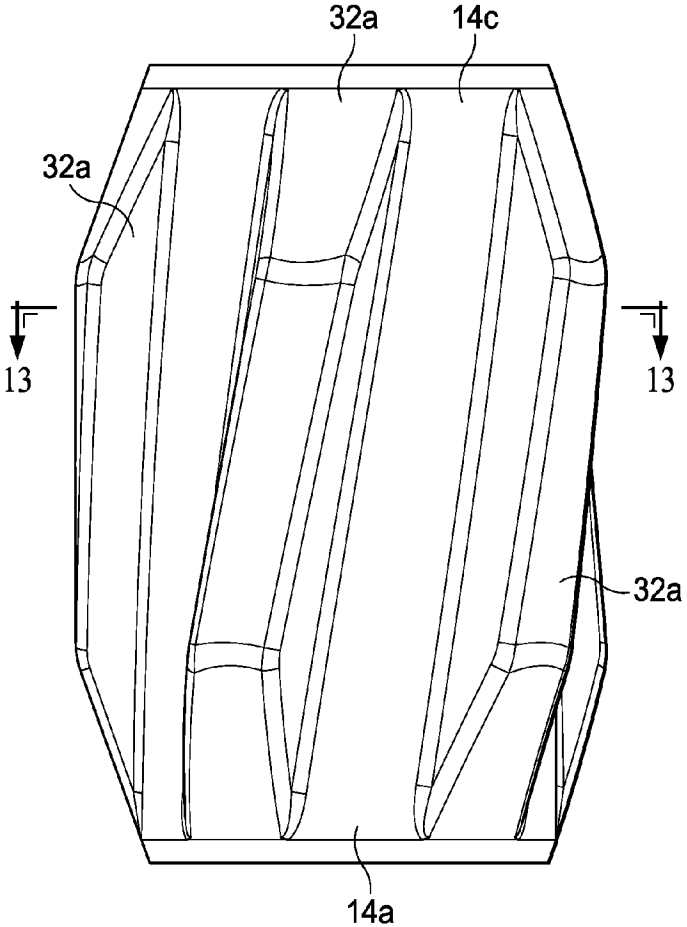
FIG. 12 is a side elevational view of the casing centralizer of FIG. 9, according to an exemplary embodiment.
Figure 11:
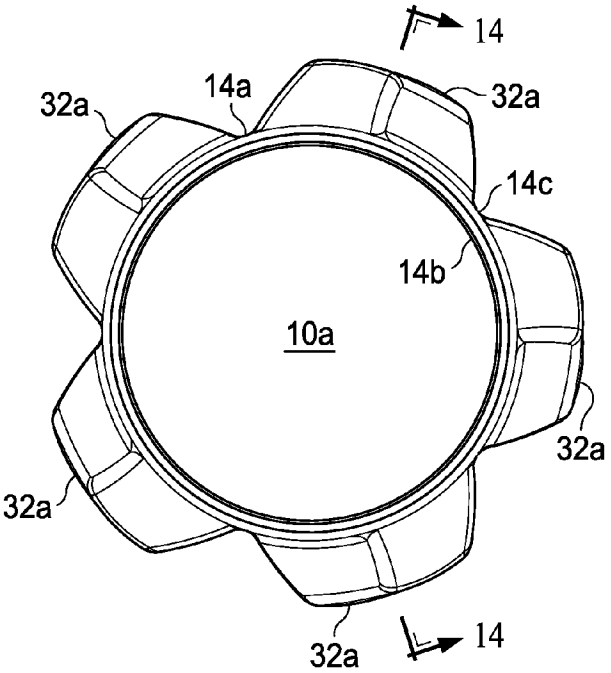
FIG. 11 is a top plan view of the casing centralizer of FIG. 9, according to an exemplary embodiment.
Figure 14:
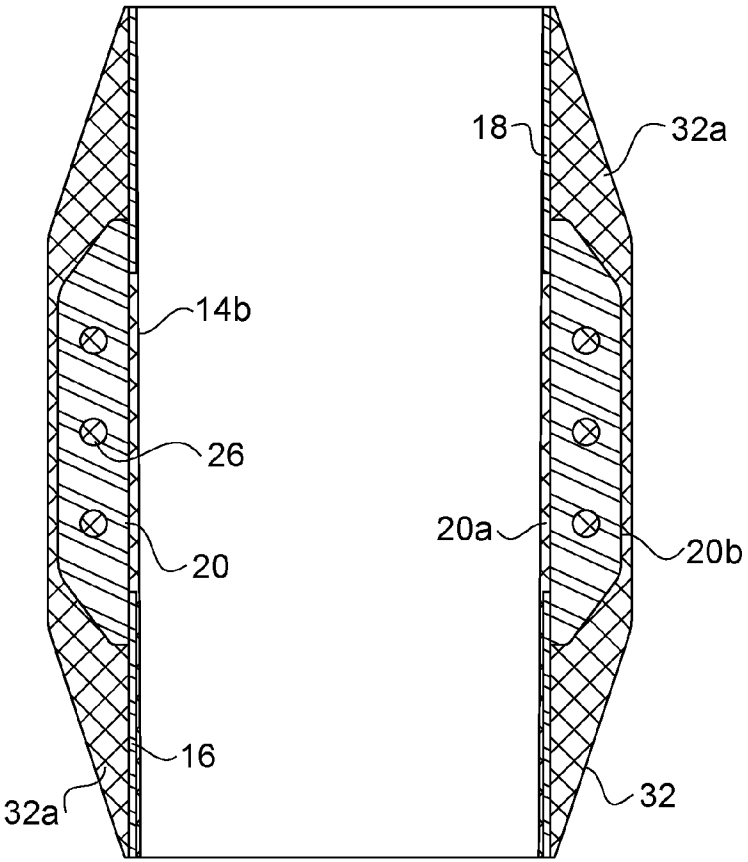
FIG. 14 is a sectional view of the casing centralizer of FIG. 11 taken along line 14-14 thereof, according to an exemplary embodiment.
Figure 13:
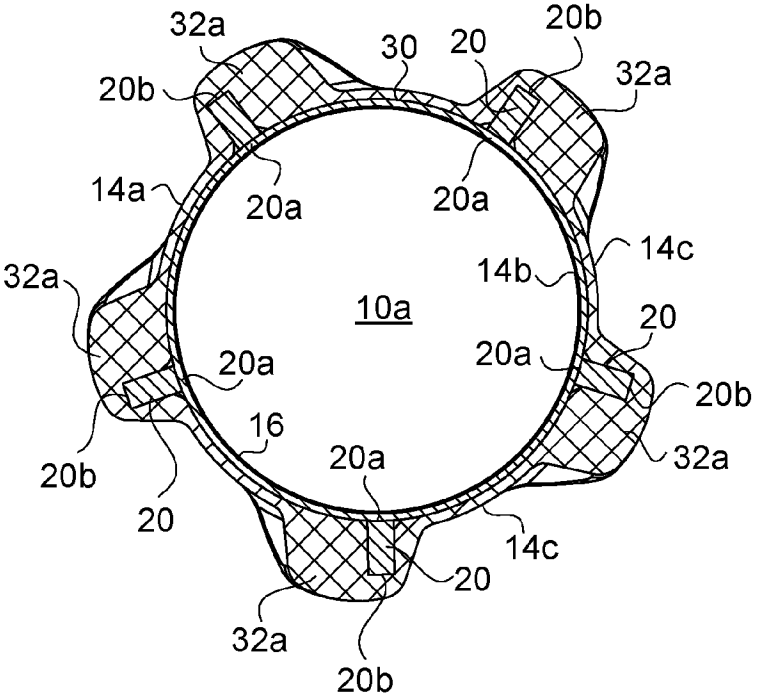
FIG. 13 is a sectional view of the casing centralizer of FIG. 12 taken along line 13-13 thereof, according to an exemplary embodiment.

In operation, in an exemplary embodiment, as illustrated in FIG. 8 with continuing reference to FIGS. 1-7, the casing centralizer 10 is inserted over a tubular 25*a*, which is, or will be, part of a tubular string or casing. As shown in FIG. 8, the tubular 25*a* extends through the internal passage 10*a* of the casing centralizer 10. The tubular string or casing is inserted into a wellbore 25*b* used in oil and gas exploration and production operations. As a result, the casing centralizer 10 is also inserted into the wellbore 25*b*. In an exemplary embodiment, before, during or after the centralizer 10 has been inserted in the wellbore 25*b*, the centralizer 10 operates to center, or centralize, the tubular 25*a* within the wellbore 25*b* in order to, for example, facilitate the insertion of cement in an annular region 25*c* defined between the outside surface of the tubular 25*a* and the wellbore 25*b*. The vane portions 14*d* prevent the tubular 25*a* from contacting the wall of the wellbore 25*b*. In an exemplary embodiment, the frame 12 is a metal frame, and the body 14 is composed of one or more non-metallic materials such as plastics; as a result, the casing centralizer 10 has high strength with low friction and thus, during operation, the casing centralizer 10 can withstand forces or loading within the wellbore 25*b* and provide low friction between, for example, the casing centralizer 10 and the wall of the wellbore 25*b*, and/or between the casing centralizer 10 and the tubular 25*a*. In several exemplary embodiments, the frame 12 is a metal frame and thus the frame 12 increases the strength of the casing centralizer 10, and the body 14 is composed of one or more non-metallic materials such as plastics and thus the body 14 provides low friction between, for example, the casing centralizer 10 and the wall of the wellbore 25*b*, and/or between the casing centralizer 10 and the tubular 25*a*.

In an exemplary embodiment, as illustrated in FIGS. 9-14 with continuing reference to FIGS. 1-8, a casing centralizer is generally referred to by the reference numeral 28 and includes a frame 30 and a body 32 covering substantially the entire frame 30. In an exemplary embodiment, to manufacture the casing centralizer 28, the frame 30 is provided, and the body 32 is overmolded around the frame 30 so that the body 32 covers substantially the entire frame 30. The frame 30 is identical to the frame 12 and thus includes the same components of the frame 12, which components are given the same reference numerals. The frame 30 will not be described in further detail. The body 32 is identical to the body 14, except that the vane portions 14*d* are omitted in favor of vane portions 32*a*. The vane portions 32*a* extend spirally between the axial end portions 16*c* and 18*c* of the frame 32. The ribs 20 of the frame 30 continue to extend between the collars 16 and 18 along a straight line. Alternatively, in an exemplary embodiment, each of the ribs 20 of the frame 30 extends spirally between the collars 16 and 18.

In operation, in an exemplary embodiment, with continuing reference to FIGS. 1-14, the casing centralizer 28 is inserted over the tubular 25*a*, which is, or will be, part of a tubular string or casing. The tubular 25*a* extends through the internal passage 10*a* of the casing centralizer 28. The tubular string or casing is inserted into a wellbore 25*b* used in oil and gas exploration and production operations. As a result, the casing centralizer 28 is also inserted into the wellbore 25*b*. In an exemplary embodiment, before, during or after the centralizer 28 has been inserted in the wellbore 25*b*, the centralizer 28 operates to center, or centralize, the tubular 25*a* within the wellbore 25*b* in order to, for example, facilitate the insertion of cement in an annular region 25*c* defined between the outside surface of the tubular 25*a* and the wellbore 25*b*. The vane portions 32*a* prevent the tubular 25*a* from contacting the wall of the wellbore 25*b*. In an exemplary embodiment, the frame 30 is a metal frame, and the body 32 is composed of one or more non-metallic materials such as plastics; as a result, the casing centralizer 28 has high strength with low friction and thus, during operation, the casing centralizer 28 can withstand forces or loading within the wellbore 25*b* and provide low friction between, for example, the casing centralizer 28 and the wall of the wellbore 25*b*, and/or between the casing centralizer 28 and the tubular 25*a*. In several exemplary embodiments, the frame 30 is a metal frame and thus the frame 30 increases the strength of the casing centralizer 28, and the body 32 is composed of one or more non-metallic materials such as plastics and thus the body 32 provides low friction between, for example, the casing centralizer 28 and the wall of the wellbore 25*b*, and/or between the casing centralizer 28 and the tubular 25*a*.

In several exemplary embodiments, the tubular string or casing, of which the tubular 25*a* is a part, and which extends through the casing centralizer 10 or 28, also extends through one or more additional casing centralizers, each of which is substantially similar to the casing centralizer 10 or 28.

Figure 15:
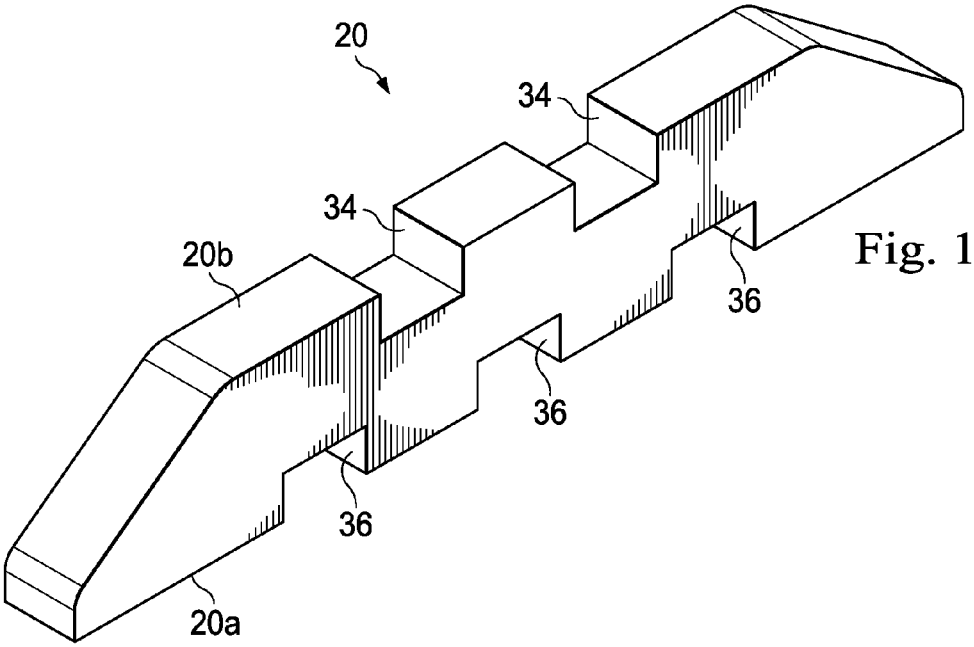
FIG. 15 is a perspective view of a rib of the frame of FIG. 2 or FIG. 10, according to another exemplary embodiment.

In an exemplary embodiment, as illustrated in FIG. 15 with continuing reference to FIGS. 1-14, the openings 26 are omitted from the rib 20. Instead, a plurality of notches 34 are formed along the distal end portion 20*b* of the rib 20, and a plurality of notches 36 are formed along the base portion 20*a* of the rib 20.

Figure 16:
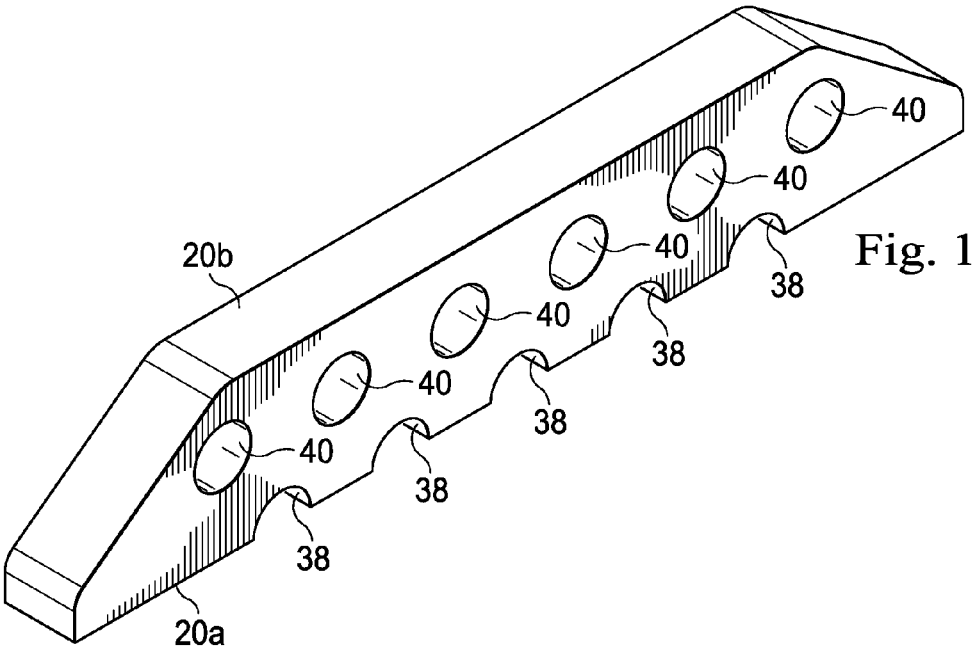
FIG. 16 is a perspective view of a rib of the frame of FIG. 2 or FIG. 10, according to yet another exemplary embodiment.

In an exemplary embodiment, as illustrated in FIG. 16 with continuing reference to FIGS. 1-15, the openings 26 are omitted from the rib 20. Instead, a plurality of notches 38 are formed along the base portion 20*a* of the rib 20, and a plurality of openings 40 are formed through the rib 20.

A casing centralizer has been described that includes a frame, including a first tubular member defining inside and outside surfaces; and a plurality of circumferentially-spaced ribs, wherein each rib includes a base portion and a distal end portion that is radially offset from the base portion, and wherein each of the respective base portions of the ribs is connected to the first tubular member; and a body including a first portion that covers the respective distal end portions of the ribs so that the respective distal end portions are disposed radially between the first portion of the body and the first tubular member. In an exemplary embodiment, the body includes a second portion that covers the inside surface of the first tubular member so that the inside surface of the first tubular member is disposed radially between the outside surface of the first tubular member and the second portion of the body. In an exemplary embodiment, the frame is composed of a first material and the body is composed of a second material that is different from the first material. In an exemplary embodiment, the first material includes a metallic material and the second material includes a non-metallic material. In an exemplary embodiment, the body covers substantially the entire frame. In an exemplary embodiment, the body is overmolded around the frame. In an exemplary embodiment, the frame further includes a second tubular member spaced axially from the first tubular member, the second tubular member defining inside and outside surfaces; wherein the ribs extend between the first and second tubular members; and wherein each of the respective base portions of the ribs is connected to each of the first and second tubular members. In an exemplary embodiment, the first portion of the body includes a plurality of vane portions, each of which covers one of the respective distal end portions of the ribs. In an exemplary embodiment, the ribs are embedded in respective ones of the vane portions. In an exemplary embodiment, the second portion of the body covers the outside surface of the first tubular member. In an exemplary embodiment, the frame further includes a second tubular member spaced axially from the first tubular member, the second tubular member defining inside and outside surfaces; wherein the ribs extend between the first and second tubular members; wherein each of the respective base portions of the ribs is connected to each of the first and second tubular members; and wherein the first portion of the body includes a plurality of vane portions, each of which extends between the first and second tubular members and covers one of the respective distal end portions of the ribs. In an exemplary embodiment, each of the vane portions extends between the first and second tubular members along a straight line. In an exemplary embodiment, each of the ribs extends between the first and second tubular members along a straight line. In an exemplary embodiment, each of the ribs extends spirally between the first and second tubular members. In an exemplary embodiment, each of the vane portions extends spirally between the first and second tubular members. In an exemplary embodiment, the body includes a second portion that covers substantially all of the respective inside surfaces of the first and second tubular members, and substantially all of the respective outside surfaces of the first and second tubular members. In an exemplary embodiment, the frame further includes a plurality of openings formed in the first tubular member. In an exemplary embodiment, the frame further includes at least one of the following: a plurality of openings formed through each of the ribs; and a plurality of notches formed in each of the ribs.

A casing centralizer has been described that includes a frame, the frame including a first tubular member; and a plurality of circumferentially-spaced bars connected to the first tubular member; and a body overmolded around the frame. In an exemplary embodiment, the frame is composed of a first material; and the body is composed of a second material that is different from the first material. In an exemplary embodiment, the first material includes a metallic material; and the second material includes a non-metallic material. In an exemplary embodiment, the frame further includes a second tubular member axially spaced from the first tubular member, wherein the plurality of circumferentially-spaced bars extends between the first and second tubular members. In an exemplary embodiment, each of the bars includes a rib, the rib including a base portion and a distal end portion that is radially offset from the base portion; and each of the base portions is connected to each of the first and second tubular members. In an exemplary embodiment, the first portion of the body includes a plurality of vane portions, each of which covers one of the respective distal end portions of the ribs; and the body includes a second portion that covers the outside surface of the first tubular member. In an exemplary embodiment, each of the vane portions extends between the first and second tubular members along a straight line. In an exemplary embodiment, each of the ribs extends between the first and second tubular members along a straight line. In an exemplary embodiment, each of the ribs extends spirally between the first and second tubular members. In an exemplary embodiment, each of the vane portions extends spirally between the first and second tubular members. In an exemplary embodiment, each of the ribs extends between the first and second tubular members along a straight line. In an exemplary embodiment, each of the ribs extends spirally between the first and second tubular members. In an exemplary embodiment, the frame further includes a first plurality of openings formed in the first tubular member; a second plurality of openings formed in the second tubular member; and at least one of the following: a third plurality of openings formed through each of the ribs; and a plurality of notches formed in each of the ribs.

A method of manufacturing a casing centralizer has been described that includes providing a frame composed of at least a first material, wherein providing the frame includes providing a first tubular member; and connecting a plurality of circumferentially-spaced bars to the first tubular member; and overmolding the frame so that a body is formed around the frame, the body being composed of at least a second material, the second material being different from the first material. In an exemplary embodiment, the first material includes a metallic material; and wherein the second material includes a non-metallic material. In an exemplary embodiment, providing the frame further includes spacing a second tubular member axially from the first tubular member; and connecting the plurality of circumferentially-spaced bars to the second tubular member so that the bars extend between the first and second tubular members. In an exemplary embodiment, each of the bars includes a rib, the rib including a base portion and a distal end portion that is radially offset from the base portion; and each of the base portions is connected to each of the first and second tubular members. In an exemplary embodiment, the frame is overmolded so that a first portion of the body is formed, the first portion comprising a plurality of vane portions, each of which covers one of the respective distal end portions of the ribs, and so that a second portion of the body is formed, the second portion of the body covering the respective outside surfaces of the first and second tubular members and the respective inside surfaces of the first and second tubular members. In an exemplary embodiment, each of the vane portions extends between the first and second tubular members along a straight line. In an exemplary embodiment, each of the ribs extends between the first and second tubular members along a straight line. In an exemplary embodiment, each of the ribs extends spirally between the first and second tubular members. In an exemplary embodiment, each of the vane portions extends spirally between the first and second tubular members. In an exemplary embodiment, each of the ribs extends between the first and second tubular members along a straight line. In an exemplary embodiment, each of the ribs extends spirally between the first and second tubular members. In an exemplary embodiment, the frame further includes at least one of the following: a plurality of openings formed through each of the ribs; and a plurality of notches formed in each of the ribs.

A casing centralizer has been described that includes a frame, including a first tubular member defining inside and outside surfaces; a second tubular member spaced axially from the first tubular member, the second tubular member defining inside and outside surfaces; and a plurality of circumferentially-spaced ribs, wherein each rib includes a base portion and a distal end portion that is radially offset from the base portion, wherein each of the respective base portions of the ribs is connected to each of the first and second tubular members, and wherein the ribs extend between the first and second tubular members; and a body, including a first portion that covers the respective distal end portions of the ribs so that the respective distal end portions are disposed radially between the first portion of the body and the first tubular member; and a second portion that covers the respective inside surfaces of the first and second tubular members so that the respective inside surfaces of the first and second tubular members are disposed radially between the respective outside surfaces of the first and second tubular members and the second portion of the body; wherein the frame is composed of a first material; and wherein the body is composed of a second material that is different from the first material. In an exemplary embodiment, the first material includes a metallic material; and the second material includes a non-metallic material.

In an exemplary embodiment, the body covers substantially the entire frame. In an exemplary embodiment, the body is overmolded around the frame. In an exemplary embodiment, the first portion of the body includes a plurality of vane portions, each of which covers one of the respective distal end portions of the ribs. In an exemplary embodiment, the ribs are embedded in respective ones of the vane portions. In an exemplary embodiment, the second portion of the body also covers the respective outside surfaces of the first and second tubular members. In an exemplary embodiment, the first portion of the body includes a plurality of vane portions, each of which extends between the first and second tubular members and covers one of the respective distal end portions of the ribs. In an exemplary embodiment, each of the vane portions extends between the first and second tubular members either spirally or along a straight line; and each of the ribs extends between the first and second tubular members either spirally or along a straight line. In an exemplary embodiment, the frame further includes a first plurality of openings formed in the first tubular member; a second plurality of openings formed in the second tubular member; and at least one of the following: a third plurality of openings formed through each of the ribs; and a plurality of notches formed in each of the ribs.

A casing centralizer has been described that includes a frame, including axially-spaced first and second tubular members; and a plurality of circumferentially-spaced bars connected to each of the first and second tubular members and extending therebetween; and a body overmolded around the frame; wherein the frame is composed of a first material; and wherein the body is composed of a second material that is different from the first material. In an exemplary embodiment, the first material includes a metallic material; and the second material includes a non-metallic material. In an exemplary embodiment, each of the bars includes a rib, the rib including a base portion and a distal end portion that is radially offset from the base portion; and each of the base portions is connected to each of the first and second tubular members. In an exemplary embodiment, the first portion of the body includes a plurality of vane portions, each of which covers one of the respective distal end portions of the ribs; and the body includes a second portion that covers the respective outside surfaces of the first and second tubular members and that covers the respective inside surfaces of the first and second tubular members. In an exemplary embodiment, each of the vane portions extends between the first and second tubular members either spirally or along a straight line; and each of the ribs extends between the first and second tubular members along a straight line. In an exemplary embodiment, the frame further includes a first plurality of openings formed in the first tubular member; a second plurality of openings formed in the second tubular member; and at least one of the following: a third plurality of openings formed through each of the ribs; and a plurality of notches formed in each of the ribs.

A method has been described that includes providing a frame composed of at least a first material, wherein providing the frame includes providing a first tubular member; spacing a second tubular member axially from the first tubular member; and connecting a plurality of circumferentially-spaced bars to the first and second tubular members so that the bars extend between the first and second tubular members; and overmolding the frame so that a body is formed around the frame, the body being composed of at least a second material, the second material being different from the first material. In an exemplary embodiment, the first material includes a metallic material; and the second material includes a non-metallic material. In an exemplary embodiment, each of the bars includes a rib, the rib including a base portion and a distal end portion that is radially offset from the base portion; and wherein each of the base portions is connected to each of the first and second tubular members. In an exemplary embodiment, the frame is overmolded so that a first portion of the body is formed, the first portion including a plurality of vane portions, each of which covers one of the respective distal end portions of the ribs; and a second portion of the body is formed, the second portion covering the respective outside surfaces of the first and second tubular members and the respective inside surfaces of the first and second tubular members.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been disclosed in detail above, the embodiments disclosed are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. A casing centralizer, comprising:

a frame, comprising:

a first tubular member defining inside and outside surfaces;

a second tubular member spaced axially from the first tubular member, the second tubular member defining inside and outside surfaces; and a plurality of circumferentially-spaced ribs, wherein each rib comprises a base portion and a distal end portion that is radially offset from the base portion, wherein each of the respective base portions of the ribs is connected to each of the first and second tubular members, and wherein the ribs extend between the first and second tubular members; and a body, comprising:

a first portion that covers the respective distal end portions of the ribs so that the respective distal end portions are disposed radially between the first portion of the body and the first tubular member; and a second portion that covers the respective inside surfaces of the first and second tubular members so that the respective inside surfaces of the first and second tubular members are disposed radially between the respective outside surfaces of the first and second tubular members and the second portion of the body;

wherein the frame is composed of a first material; and wherein the body is composed of a second material that is different from the first material.

2. The casing centralizer of claim 1, wherein the first material comprises a metallic material; and wherein the second material comprises a non-metallic material.

3. The casing centralizer of claim 1, wherein the body covers substantially the entire frame.

4. The casing centralizer of claim 3, wherein the body is overmolded around the frame.

5. The casing centralizer of claim 1, wherein the first portion of the body comprises a plurality of vane portions, each of which covers one of the respective distal end portions of the ribs.

6. The casing centralizer of claim 5, wherein the ribs are embedded in respective ones of the vane portions.

7. The casing centralizer of claim 1, wherein the second portion of the body also covers the respective outside surfaces of the first and second tubular members.

8. The casing centralizer of claim 1, wherein the first portion of the body comprises a plurality of vane portions, each of which extends between the first and second tubular members and covers one of the respective distal end portions of the ribs.

9. The casing centralizer of claim 8, wherein each of the vane portions extends between the first and second tubular members either spirally or along a straight line; and wherein each of the ribs extends between the first and second tubular members either spirally or along a straight line.

10. The casing centralizer of claim 1, wherein the frame further comprises:

a first plurality of openings formed in the first tubular member;

a second plurality of openings formed in the second tubular member; and at least one of the following:

a third plurality of openings formed through each of the ribs; and a plurality of notches formed in each of the ribs.

11. A casing centralizer, comprising:

a frame, comprising:

axially-spaced first and second tubular members;

a plurality of circumferentially-spaced bars connected to each of the first and second tubular members and extending therebetween, wherein each of the bars comprises a rib, the rib comprising a base portion and a distal end portion that is radially offset from the base portion; and wherein each of the base portions is connected to each of the first and second tubular members; and a body overmolded around the frame;

wherein the frame is composed of a first metallic material; and wherein the body is composed of a second non-metallic material.

12. The casing centralizer of claim 11, wherein the first portion of the body comprises a plurality of vane portions, each of which covers one of the respective distal end portions of the ribs; and wherein the body comprises a second portion that covers the respective outside surfaces of the first and second tubular members and that covers the respective inside surfaces of the first and second tubular members.

13. The casing centralizer of claim 12, wherein each of the vane portions extends between the first and second tubular members either spirally or along a straight line; and wherein each of the ribs extends between the first and second tubular members along a straight line.

14. The casing centralizer of claim 11, wherein the frame further comprises:

a first plurality of openings formed in the first tubular member;

a second plurality of openings formed in the second tubular member; and at least one of the following:

a third plurality of openings formed through each of the ribs; and a plurality of notches formed in each of the ribs.

15. A method of manufacturing a casing centralizer, the method comprising:

providing a frame composed of at least a first material, wherein providing the frame comprises:

providing a first tubular member;

spacing a second tubular member axially from the first tubular member; and connecting a plurality of circumferentially-spaced bars to the first and second tubular members so that the bars extend between the first and second tubular members, wherein each of the bars comprises a rib, the rib comprising a base portion and a distal end portion that is radially offset from the base portion; and wherein each of the base portions is connected to each of the first and second tubular members; and overmolding the frame so that a body is formed around the frame, the body being composed of at least a second material, the second material being different from the first material, wherein the first material comprises a metallic material and wherein the second material comprises a non-metallic material.

16. The method of claim 15, wherein the frame is overmolded so that:

a first portion of the body is formed, the first portion comprising a plurality of vane portions, each of which covers one of the respective distal end portions of the ribs; and a second portion of the body is formed, the second portion covering the respective outside surfaces of the first and second tubular members and the respective inside surfaces of the first and second tubular members.

* * * * *